US011071335B2

(12) United States Patent
Kulkarni

(10) Patent No.: US 11,071,335 B2
(45) Date of Patent: Jul. 27, 2021

(54) WEIGHTED CHEST PROTECTOR

(71) Applicant: Tejus Kulkarni, New York, NY (US)

(72) Inventor: Tejus Kulkarni, New York, NY (US)

( * ) Notice: Subject to any disclaimer, the term of this patent is extended or adjusted under 35 U.S.C. 154(b) by 260 days.

(21) Appl. No.: 16/216,627

(22) Filed: Dec. 11, 2018

(65) Prior Publication Data

US 2020/0179742 A1 Jun. 11, 2020

(51) Int. Cl.
*A41D 13/05* (2006.01)
*A63B 71/12* (2006.01)
*A63B 21/065* (2006.01)

(52) U.S. Cl.
CPC ..... *A41D 13/0518* (2013.01); *A63B 21/065* (2013.01); *A63B 71/12* (2013.01); *A63B 2071/1208* (2013.01)

(58) Field of Classification Search
CPC ..... A63B 21/065; A63B 71/12; A63B 2071/1208; A63B 2069/0011; A41D 13/0007; A41D 13/02; A41D 13/0518; A41D 13/0153; A41D 13/0568; A41D 13/0556; A41D 13/0512
USPC ..... 2/463
See application file for complete search history.

(56) References Cited

U.S. PATENT DOCUMENTS 932,352 A * 8/1909 Sullivan ..... A63B 71/12 2/462
1,777,620 A * 10/1930 Modesitt ..... A41D 13/02 2/231
1,827,585 A * 10/1931 Kautz ..... A41D 13/02 2/247
1,935,296 A * 11/1933 Joyce ..... A41D 13/02 2/227
2,990,549 A * 7/1961 Doughty ..... A63B 71/12 2/463
3,076,197 A * 2/1963 Glahe ..... A63B 71/12 2/463
3,557,384 A * 1/1971 Barron et al. ..... F41H 1/02 2/2.5
3,559,210 A * 2/1971 Hansen ..... F41H 5/0428 2/2.5
4,272,847 A * 6/1981 Buhler ..... A63B 71/12 2/461
4,332,379 A * 6/1982 Bannister ..... A63B 21/065 224/148.5
4,382,302 A * 5/1983 Watson ..... A63B 21/065 2/102
4,394,012 A * 7/1983 Egbert ..... A63B 21/065 2/250
4,407,497 A * 10/1983 Gracie ..... A63B 21/065 128/DIG. 15

(Continued)

*Primary Examiner* — Heather Mangine
(74) *Attorney, Agent, or Firm* — Kristin Grant; Grant Attorneys at Law PLLC

(57) ABSTRACT

A weighted chest protector, including a front panel, a rear panel, an adjustable shoulder panel, and a stability strap. The rear panel having a horizontal bottom edge and a horizontal strap extending from each side of the horizontal bottom edge for connecting the rear panel to the front panel. The adjustable shoulder panel having a first end and a second end, and a weight affixed to the adjustable shoulder panel at a location is which is closer to the second end of the adjustable shoulder panel than to the first end of the adjustable shoulder panel. The stability strap extending vertically between the rear panel and the adjustable shoulder panel.

21 Claims, 3 Drawing Sheets

(56) References Cited

U.S. PATENT DOCUMENTS 4,497,069 A * 2/1985 Braunhut ..... F41H 1/02 2/2.5
4,525,875 A * 7/1985 Tomczak ..... A41D 13/0518 2/2.5
4,610,035 A * 9/1986 Mattila ..... A41D 13/0518 2/16
4,658,442 A * 4/1987 Tomlinson ..... A63B 21/065 2/102
4,847,913 A * 7/1989 Chen ..... A41D 13/0156 2/463
4,948,122 A * 8/1990 Andrews, Sr. ..... A63B 21/065 482/105
4,989,267 A * 2/1991 Watson ..... A63B 21/065 2/102
5,024,360 A * 6/1991 Rodriguez ..... A41D 13/0012 2/102
5,060,314 A * 10/1991 Lewis ..... F41H 1/02 2/2.5
5,144,694 A * 9/1992 Conrad Da oud ... A63B 21/065 2/102
5,398,340 A * 3/1995 Kibbee ..... F41H 1/02 2/102
5,553,322 A * 9/1996 Cebo-Johnson ..... A63B 21/065 2/69
5,623,729 A * 4/1997 Chen ..... A41D 13/0153 2/2.5
5,669,080 A * 9/1997 Culton ..... A63B 71/12 2/455
5,768,706 A * 6/1998 Griffith ..... A63B 21/065 2/102
5,966,747 A * 10/1999 Crupi ..... F41H 1/02 2/2.5
5,974,585 A * 11/1999 Bachner, Jr. ..... F41H 1/02 2/2.5
5,978,964 A * 11/1999 Gaston ..... A63B 21/065 2/228
6,079,055 A * 6/2000 Mencel ..... A41D 13/0512 2/268
6,081,924 A * 7/2000 Ott ..... A63B 21/065 2/102
6,161,226 A * 12/2000 Serewicz ..... A41D 13/015 2/45
6,182,299 B1 * 2/2001 Chen ..... A41D 13/0518 2/463
6,202,214 B1 * 3/2001 Light ..... A41D 13/0512 2/268
6,209,135 B1 * 4/2001 Irvin ..... A63B 21/0603 2/102
6,375,537 B1 * 4/2002 Jankowski ..... A41C 3/0057 2/463
6,421,833 B2 * 7/2002 Khanamirian ..... A41D 13/0007 182/3
6,665,879 B2 * 12/2003 VandenBerg ..... A63B 21/065 2/102
6,675,391 B2 * 1/2004 Morrison ..... A63B 21/065 2/102
7,090,558 B2 * 8/2006 Ott ..... A41C 3/0057 2/69
7,093,301 B1 * 8/2006 Moore, Jr. ..... A41D 13/0518 2/2.5
7,490,361 B1 * 2/2009 Floyd ..... A41D 13/0512 2/94
7,707,652 B2 * 5/2010 Senegal ..... A63B 21/4043 2/102
7,900,283 B1 * 3/2011 Chen ..... F41H 1/00 2/455
8,215,773 B2 * 7/2012 Gibson-Horn ..... A61F 5/026 351/203
8,262,545 B1 * 9/2012 Beber ..... A63B 21/065 482/105
8,353,065 B1 * 1/2013 Crye ..... F41H 1/02 2/102
8,353,067 B2 * 1/2013 Chen ..... A41D 13/0518 2/463
8,443,465 B2 * 5/2013 Stewart ..... A63B 21/0601 2/94
8,490,212 B1 * 7/2013 Asher ..... A41D 1/04 2/2.5
9,278,245 B2 * 3/2016 Marji ..... A63B 21/4033
9,427,033 B2 * 8/2016 Blakely ..... A41D 31/125
10,004,936 B1 * 6/2018 Ekstrom ..... A63B 21/4007
10,286,249 B1 * 5/2019 Sibhatu ..... A63B 21/065
10,322,309 B2 * 6/2019 Feldman ..... A63B 21/4007
2002/0162162 A1 * 11/2002 Collins ..... A41D 13/0158 2/463
2005/0005343 A1 * 1/2005 Johnson ..... F41H 1/02 2/102
2006/0195962 A1 * 9/2006 Jordan ..... A41D 13/0007 2/69
2007/0143908 A1 * 6/2007 Phillips ..... A41D 13/0512 2/459
2008/0216219 A1 * 9/2008 Desnoyers ..... A41D 13/0153 2/463
2011/0131713 A1 * 6/2011 DaRosa ..... F41H 1/02 2/463
2011/0219524 A1 * 9/2011 Perreault ..... A41D 13/0518 2/463
2012/0084906 A1 * 4/2012 Sego, Jr. ..... F41H 1/02 2/463
2013/0104302 A1 * 5/2013 Fream ..... A63B 71/12 2/461
2013/0190144 A1 * 7/2013 Ross ..... A63B 23/047 482/105
2013/0296756 A1 * 11/2013 Troncoso ..... A61F 5/026 602/19
2014/0289938 A1 * 10/2014 Brown ..... A63B 71/12 2/455
2015/0211829 A1 * 7/2015 Cole ..... F41H 1/02 2/463
2016/0287924 A1 * 10/2016 Robinson ..... A63B 21/00065
2016/0316895 A1 * 11/2016 Roque ..... A45F 3/04
2016/0367848 A1 * 12/2016 Seuk ..... A63B 21/00065
2017/0007908 A1 * 1/2017 McNeil ..... A63B 71/12
2017/0013891 A1 * 1/2017 Olvera ..... A41D 13/02
2017/0203191 A1 * 7/2017 Lemieux ..... A41D 13/0518
2017/0354860 A1 * 12/2017 Bennett ..... A63B 71/12
2018/0056107 A1 * 3/2018 Clarke ..... A63B 21/065
2018/0318692 A1 * 11/2018 Guidetti ..... A41D 13/0007
2019/0059466 A1 * 2/2019 Broughton ..... A41B 9/06
2019/0255416 A1 * 8/2019 Strickland ..... A63B 71/0622
2019/0357605 A1 * 11/2019 Homan ..... A41D 13/0518

* cited by examiner

WEIGHTED CHEST PROTECTOR

BACKGROUND

Field of the Invention

The present invention relates generally to chest protectors, and in particular, to a chest protector with one or more removable weights for providing resistance during drills and other training exercises.

Related Art

Chest protectors are commonly worn during baseball or softball games, practice, and drills over the chest of an umpire or catcher in order to shield the body from injury. Traditional chest protectors are typically lightweight padded vests where, in some instances, the padding is segmented in order to absorb the greatest amount of shock.

Weighted chest protectors are not commonly known for use in sports, however, weighted vests have been long used in exercise and training where the weights add resistance and intensity to any training session. For example, U.S. Pat. No. 4,382,302 discloses a weighted training vest having constant weight distribution comprising of front and rear panels each with a plurality of detachable weights spaced at predetermined distances apart; U.S. Pat. No. 4,658,442 discloses a snuggly fit variable vest for use during exercise where the weights are designed to fit snuggly within pockets in the vest; U.S. Pat. No. 4,394,012 discloses a weighted exercise vest allowing uniform size and shape weights to fit snuggly within pockets in the vest.

The present invention discloses an improved chest protector for use during drills and other training sessions comprising of removable weights for optimizing the wearers natural movements and increasing endurance and strength.

SUMMARY OF THE INVENTION

It is to be understood that the phraseology and terminology employed herein are for the purpose of the description and should not be regarded as limiting.

The present invention is directed to a weighted chest protector comprising a front panel, a rear panel, an adjustable shoulder panel, and a stability strap. The adjustable shoulder panel comprising a first end comprising of a first connector for connecting the shoulder panel to the front panel of the weighted chest protector, a second end comprising of a second connector for connecting the shoulder panel to the rear panel of the weighted chest protector via a stability strap, and a weight affixed proximally to the second end of the shoulder panel of the weighted chest protector. The stability strap comprising a first end and a second end, the first end removably connected to the second connector of the shoulder panel and the second end removably affixed to a lower portion of the rear panel. These and other features of the present invention will become readily apparent upon further review of the specification and drawings.

BRIEF DESCRIPTION OF THE DRAWINGS

Embodiments of the present invention will be described by way of example only, and not limitation, with reference to the accompanying drawings in which.

DETAILED DESCRIPTION

Figure 1:
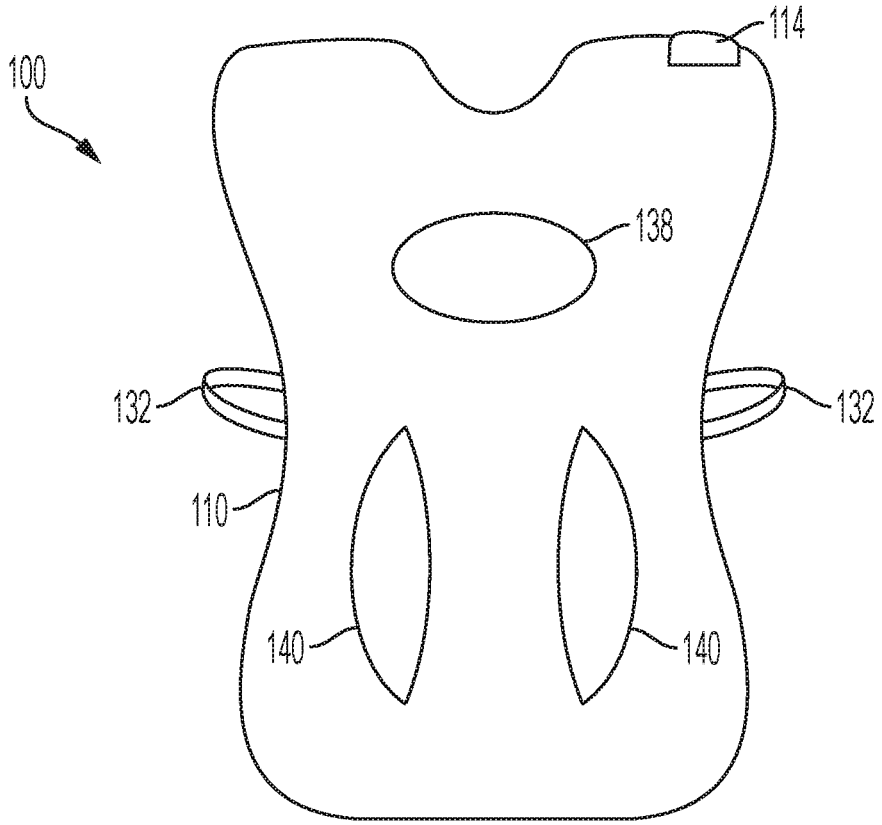
FIG. 1 is front perspective view of a weighted chest protector according to an embodiment of the present invention.
Figure 2A:
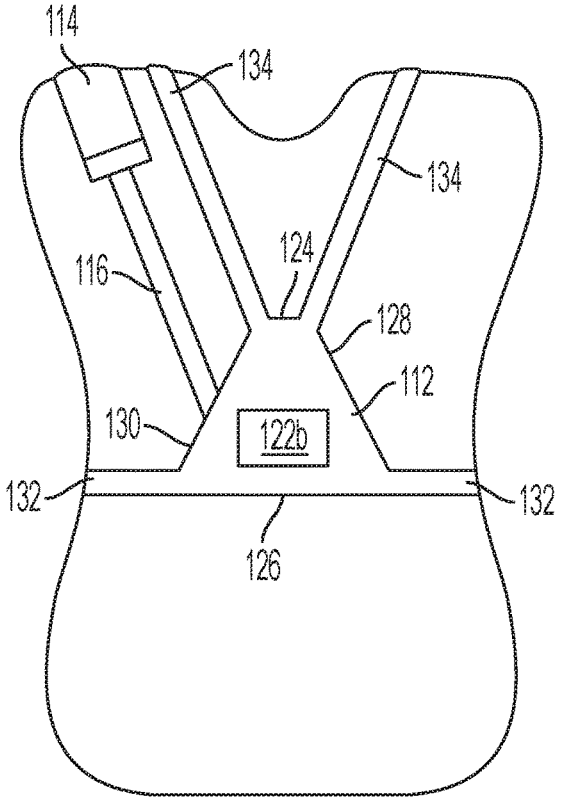
FIG. 2*a* is a rear perspective view of a weighted chest protector according to an embodiment of the present invention.
Figure 2B:
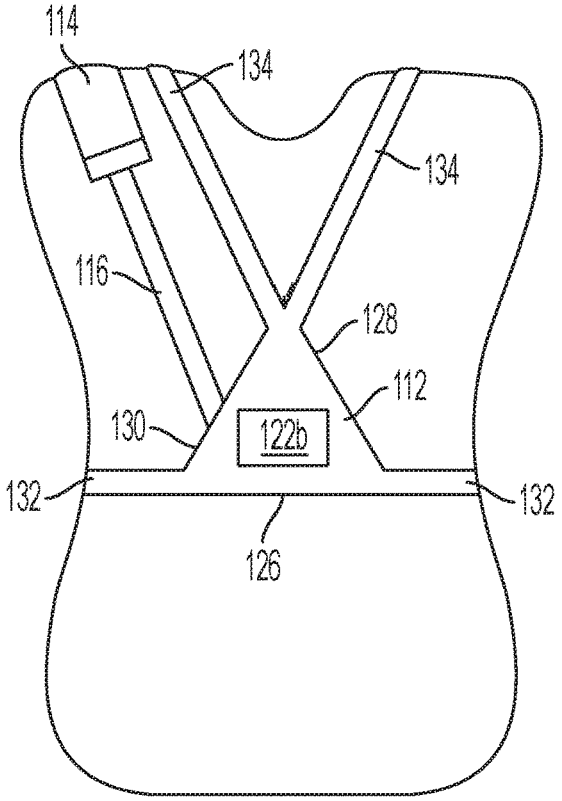
FIG. 2*b* is a rear perspective view of a weighted chest protector according to an embodiment of the present invention.
Figure 3:
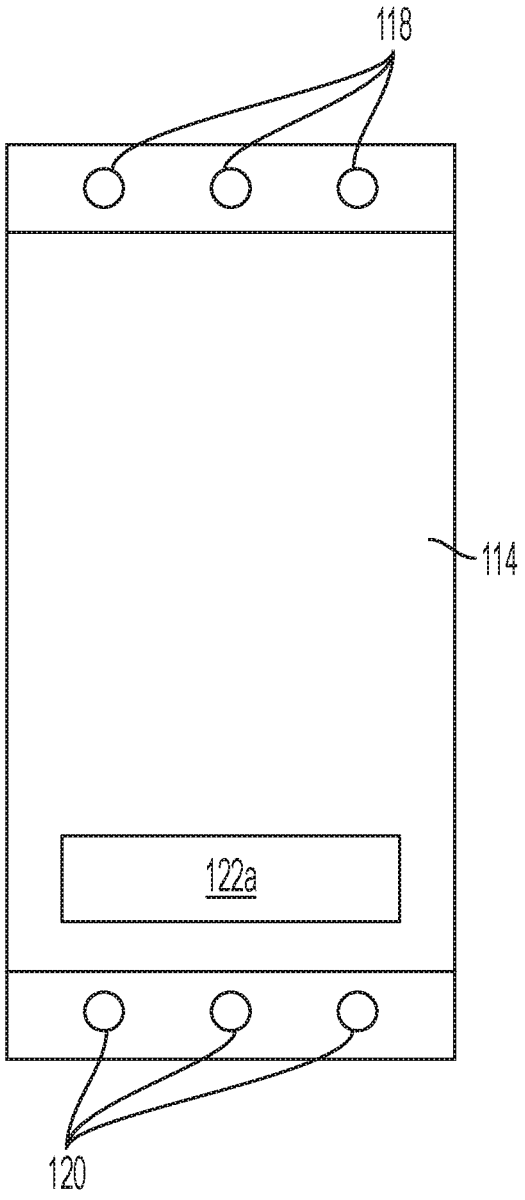
FIG. 3 is a bottom view of a shoulder panel of a weighted chest protector according to an embodiment of the present invention.

Referring now to the figures, where similar reference characters denote similar elements throughout the figures, FIGS. 1, 2*a* and 2*b* are front and rear perspective views of a weighted chest protector 100 according to an embodiment of the present invention and FIG. 3 is a bottom view of an adjustable shoulder panel 114 according to an embodiment of the present invention.

The weighted chest protector 100 comprising a front panel 110 comprising, a first connector 118 on a portion of the front panel 110 configured to sit on a wearer's shoulder, the first connector 118 of the front panel having one or more parts, a rear panel 112, an adjustable shoulder panel 114, and a stability strap 116. The stability strap 116 having a first end and a second end the first end having a second connector having one or more parts for removably connecting the stability strap 116 to a second end of the adjustable shoulder panel 114 and the second end of the stability strap 116 removably connected to a lower portion of the rear panel 112. The stability strap for stabilizing a weight 122*a* of the shoulder panel.

The adjustable shoulder panel 114 comprising a first end comprising a first connector 118, the first connector having one or more parts which correspond to the one or more parts of the first connector of the front panel for connecting the shoulder panel 114 to the front panel 110 of the weighted chest protector 100. The adjustable shoulder panel also having a second end comprising a second connector 120, the second connector having one or more parts which correspond to one or more parts of the second connector of the stability strap for connecting the shoulder panel 114 to the rear panel 112 of the weighted chest protector 100 via the stability strap 116, and the weight 122*a* affixed proximally to the second end of the adjustable shoulder panel 114. The first connector 118 and the second connector 120 preferably being a snap fasteners but any male-female fastener which is commonly known in the art may be used, this may include but is not limited to hook and loop fasteners or buttons. The weight 122*a* may either be permanently affixed to the shoulder panel 114 or removably affixed by any means commonly known in the art, which may include but is not limited to magnets, buttons, hook and loop fasteners, pockets. The weight 122*a* for providing resistance to a wearer during drills and training and assists in improving throwing speed during games. The front panel 110 further comprising of a front weight 138 centrally located on an upper section of the front panel 110 and a side weight 140 on each side of a lower portion of the front panel 110 wherein the side weights 148 are of equal weight.

In a preferred embodiment of the present invention, the adjustable shoulder panel 118 is a rectangle and the rear panel 112 is a trapezoid having a horizontal top edge 124 parallel to a horizontal bottom edge 126 where the bottom edge 126 is longer than the top edge 124, and two side edges 128, 130 longitudinally converging from the corners of the bottom edge 126 to the corners of the top edge 124. The rear panel 112 having a horizontal strap 132 extending from each side of the bottom edge 126 for connecting the rear panel 112 to the front panel 110, and a vertical strap 134 extending front the top edge 124 for connecting the rear panel 112 to the front panel 110. The horizontal straps 132 and the vertical straps 134 are adjustable to a wearer's size and may include elastic, buckles or other adjusting means commonly known in the art. The rear panel also comprising of a centrally located weight 122*b* for providing resistance thereby increasing speed and improving a wearer's natural movements. In a perfect fit, the weight of the rear panel sits within the wearer's thoracic vertebrae. The weighted chest protector made of washable materials.

In another embodiment of the present invention according to FIG. 2*b*, the adjustable shoulder panel 114 is a rectangle and the rear panel 12 is a triangle having a horizontal bottom edge 126 and two side edges 128, 130 longitudinally converging from the corners of the bottom edge 126 to a meet forming a point. The rear panel 112 having a horizontal strap 132 extending from each side of the bottom edge 126 for connecting the rear panel 112 to the front panel 110, and two vertical straps 134 extending from the point for connecting the rear panel 112 to the front panel 110. The horizontal straps 132 and the vertical straps 134 are adjustable to a wearer's size and may include elastic, buckles or other adjusting means commonly known in the art. The rear panel also comprising of a centrally located weight 122*b* for providing resistance thereby increasing speed and improving a wearer's natural movements.

What is claimed is:

1. A weighted chest protector, comprising:

(a) a front panel comprising a first connector on a portion of the front panel that is configured to sit on a wearer's shoulder, the first connector of the front panel having one or more parts:

(b) a rear panel, wherein the rear panel is a trapezoid comprising of a horizontal top edge parallel to a horizontal bottom edge where the horizontal bottom edge is longer than the horizontal top edge, and two side edges each longitudinally extending between the horizontal bottom edge and the horizontal the top edge, and wherein the rear panel comprises a horizontal strap extending from each side of the horizontal bottom edge for connecting the rear panel to the front panel, and a vertical strap extending from each side of the top edge for connecting the rear panel to the front panel;

(c) a stability strap extending vertically between the rear panel and an adjustable shoulder panel, the stability strap having a first end and a second end, the first end of the stability strap comprising a second connector having one or more parts for removably connecting the first end of the stability strap to a second end of the adjustable shoulder panel, the second end of the stability strap removably connected to a lower portion of the rear panel, and (d) the adjustable shoulder panel comprising:

(i) a first end comprising a first connector, the first connector of the adjustable shoulder panel having one or more parts which correspond to the one or more parts of the first connector of the front panel for securing the first end of the adjustable shoulder panel to the front panel:

(ii) the second end comprising a second connector, the second connector of the adjustable shoulder panel having one or more parts which correspond to the one or more parts of the second connector of the stability strap for removably connecting the second end of the adjustable shoulder panel to the first end of the stability strap; and (iii) a weight affixed to the adjustable shoulder panel at a location which is closer to the second end of the adjustable shoulder panel than to the first end of the adjustable shoulder panel.

2. The weighted chest protector of claim 1, wherein the adjustable shoulder panel is a rectangle.

3. The weighted chest protector of claim 1, wherein the one or more parts of the first connector and the second connector comprise snap fasteners.

4. The weighted chest protector of claim 1, wherein the weight of the shoulder panel is removable.

5. The weighted chest protector of claim 1, wherein the front panel further comprises of a front weight centrally located on an upper section of the front panel and a side weight on each side of a lower portion of the front panel wherein the side weights are of equal weight.

6. The weighted chest protector of claim 1, wherein the rear panel further comprises of a centrally located weight.

7. The weighted chest protector of claim 6, wherein the centrally located weight is removably connected to the rear panel.

8. A weighted chest protector, comprising:

(a) a front panel comprising a first connector on a portion of the front panel that is configured to sit on a wearer's shoulder, the first connector of the front panel having one or more parts;

(b) a rear panel, wherein the rear panel is a triangle comprising of a horizontal bottom edge and two side edges longitudinally converging from the horizontal bottom edge and meeting to form a point, and wherein the rear panel comprises a horizontal strap extending from each side of the horizontal bottom edge for connecting the rear panel to the front panel, and two vertical straps extending from the point for connecting the rear panel to the front panel;

(c) a stability strap extending vertically between the rear panel and an adjustable shoulder panel, the stability strap having a first end and a second end, the first end of the stability strap comprising a second connector having one or more parts for removably connecting the first end of the stability strap to a second end of the adjustable shoulder panel, the second end of the stability strap removably connected to a lower portion of the rear panel; and (d) the adjustable shoulder panel comprising:

(i) a first end comprising a first connector, the first connector of the adjustable shoulder panel having one or more parts which correspond to the one or more parts of the first connector of the front panel for securing the first end of the adjustable shoulder panel to the front panel;

(ii) the second end comprising a second connector, the second connector of the adjustable shoulder panel having one or more parts which correspond to the one or more parts of the second connector of the stability strap for removably connecting the second end of the adjustable shoulder panel to the first end of the stability strap: and (iii) a weight affixed to the adjustable shoulder panel at a location which is closer to the second end of the adjustable shoulder panel than to the first end of the adjustable shoulder panel.

9. The weighted chest protector of claim 8, wherein the rear panel further comprises of a centrally located weight.

10. The weighted chest protector of claim 9, wherein the centrally located weight is removably connected to the rear panel.

11. The weighted chest protector of claim 8, wherein the adjustable shoulder panel is a rectangle.

12. The weighted chest protector of claim 1, wherein the one or more parts of the first connector and the second connector comprise snap fasteners.

13. The weighted chest protector of claim 8, wherein the weight of the shoulder panel is removable.

14. The weighted chest protector of claim 8, wherein the front panel further comprises of a front weight centrally located on an upper section of the front panel and a side weight on each side of a lower portion of the front panel, wherein the side weights are of equal weight.

15. A weighted chest protector, comprising:

(a) a front panel comprising a first connector on a portion of the front panel that is configured to sit on a wearer's shoulder, the first connector of the front panel having one or more parts;

(b) a rear panel, wherein the rear panel comprises of a horizontal bottom edge and a horizontal top edge, and wherein the rear panel comprises a horizontal strap extending from each side of the horizontal bottom edge for connecting the rear panel to the front panel, and two vertical straps extending from the horizontal top edge for connecting the rear panel to the front panel;

(c) a stability strap extending vertically between the rear panel and an adjustable shoulder panel, the stability strap having a first end and a second end, the first end of the stability strap comprising a second connector having one or more parts for removably connecting the first end of the stability strap to a second end of the adjustable shoulder panel, the second end of the stability strap removably connected to a lower portion of the rear panel; and (h) the adjustable shoulder panel comprising:

(i) a first end comprising a first connector, the first connector of the adjustable shoulder panel having one or more parts which correspond to the one or more parts of the first connector of the front panel for securing the first end of the adjustable shoulder panel to the front panel;

(ii) the second end comprising a second connector, the second connector of the adjustable shoulder panel having one or more parts which correspond to the one or more parts of the second connector of the stability strap for removably connecting the second end of the adjustable shoulder panel to the first end of the stability strap; and (iii) a weight affixed to the adjustable shoulder panel at a location which is closer to the second end of the adjustable shoulder panel than to the first end of the adjustable shoulder panel.

16. The weighted chest protector of claim 15, wherein the rear panel further comprises of a centrally located weight.

17. The weighted chest protector of claim 16, wherein the centrally located weight is removably connected to the rear panel.

18. The weighted chest protector of claim 15, wherein the rear panel further comprises of a centrally located weight.

19. The weighted chest protector of claim 18, wherein the centrally located weight is removably connected to the rear panel.

20. The weighted chest protector of claim 15, wherein the weight of the shoulder panel is removable.

21. The weighted chest protector of claim 15, wherein the front panel further comprises of a front weight centrally located on an upper section of the front panel and a side weight on each side of a lower portion of the front panel, wherein the side weights are of equal weight.

* * * * *